US009278741B2

(12) United States Patent
Merchant et al.

(10) Patent No.: US 9,278,741 B2
(45) Date of Patent: Mar. 8, 2016

(54) SEMI-SUBMERSIBLE PLATFORM WITH A MOVABLE SUBMERGIBLE PLATFORM FOR DRY DOCKING A VESSEL

(71) Applicant: Keppel Offshore & Marine Ltd., Singapore (SG)

(72) Inventors: Aziz Amirali Merchant, Singapore (SG); Anis Altaf Hussain, Singapore (SG); Suryanarayana Murthy Pasumarthy, Singapore (SG)

(73) Assignee: Keppel Offshore & Marine Ltd., Singapore (SG)

( * ) Notice: Subject to any disclaimer, the term of this patent is extended or adjusted under 35 U.S.C. 154(b) by 0 days.

(21) Appl. No.: 14/376,793

(22) PCT Filed: Jan. 30, 2013

(86) PCT No.: PCT/SG2013/000038
§ 371 (c)(1),
(2) Date: Aug. 5, 2014

(87) PCT Pub. No.: WO2013/119180
PCT Pub. Date: Aug. 15, 2013

(65) Prior Publication Data

US 2014/0373767 A1 Dec. 25, 2014

(30) Foreign Application Priority Data

Feb. 7, 2012 (SG) ..... 201200879-3

(51) Int. Cl.
*B63C 1/04* (2006.01)
*B63C 1/02* (2006.01)

(52) U.S. Cl.
CPC .... *B63C 1/04* (2013.01); *B63C 1/02* (2013.01)

(58) Field of Classification Search
CPC ..... B63C 1/04
USPC ..... 114/45–54
See application file for complete search history.

(56) References Cited

U.S. PATENT DOCUMENTS 3,674,042 A * 7/1972 Deal, Jr. ..... B63B 9/00 114/40
3,976,022 A * 8/1976 Lapeyre ..... B63C 3/06 114/45

(Continued)

FOREIGN PATENT DOCUMENTS

DE 19943693 A1 7/2002
EP 1400442 A1 3/2004

(Continued)

OTHER PUBLICATIONS

International Preliminary Report on Patentability for Application No. PCT/SG2013/000038, Date Issued May 20, 2014, Mailed Aug. 7, 2014, 21 pgs.

(Continued)

*Primary Examiner* — Lars A Olson
*Assistant Examiner* — Jovon Hayes
(74) *Attorney, Agent, or Firm* — KPPB LLP

(57) ABSTRACT

The present invention disclosed in this application relates to a semi-submersible platform with a landing bay. The landing bay has a movable platform that allows the docked vessel to be raised/lowered from/to a body of water. The landing bay also has a stabilizing mechanism for holding a docked vessel stable when the platform is in motion.

18 Claims, 7 Drawing Sheets

(56) References Cited

U.S. PATENT DOCUMENTS

| | | | | | |
|---|---|---|---|---|---|
| 4,282,822 | A * | 8/1981 | Jackson | B63B 59/045 | 114/222 |
| 4,495,880 | A * | 1/1985 | Maniscalco | B63B 35/42 | 114/123 |
| 4,660,677 | A * | 4/1987 | Hunter | B63B 23/32 | 114/366 |
| 5,131,342 | A * | 7/1992 | Sackett | B63C 3/06 | 114/344 |
| 5,215,024 | A * | 6/1993 | McAllister | B63C 1/10 | 114/219 |
| 6,152,065 | A * | 11/2000 | Gronstrand | B63B 23/30 | 114/258 |
| 6,805,598 | B2 * | 10/2004 | Goldbach | B65D 88/78 | 114/74 R |
| 7,419,329 | B1 * | 9/2008 | Tafoya | B63C 3/06 | 114/44 |
| 7,547,159 | B1 * | 6/2009 | Warters | B63C 3/06 | 114/44 |
| 8,181,586 | B1 * | 5/2012 | Roumell | B63C 1/00 | 114/292 |
| 2006/0278153 | A1 * | 12/2006 | Towley, III | B63C 13/00 | 114/264 |
| 2008/0008528 | A1 * | 1/2008 | Hey | B63C 3/06 | 405/3 |
| 2009/0067961 | A1 * | 3/2009 | Perez-Rodenas Espada | B63C 15/00 | 414/281 |
| 2009/0317212 | A1 * | 12/2009 | Munson, Jr. | B63B 35/44 | 414/138.1 |
| 2010/0272517 | A1 * | 10/2010 | Montgomery | E02B 3/20 | 405/218 |
| 2014/0373767 | A1 * | 12/2014 | Merchant | B63C 1/02 | 114/48 |

FOREIGN PATENT DOCUMENTS

| | | | | |
|---|---|---|---|---|
| FR | 2273707 | A1 | 1/1976 | |
| GB | 370250 | A | 4/1932 | |
| GB | 1318484 | A | 5/1973 | |
| JP | 1122794 | A | 5/1989 | |
| WO | WO 2009048342 | A2 * | 4/2009 | E02B 3/20 |

OTHER PUBLICATIONS

International Search Report on for Application No. PCT/SG2013/000038, Search Completed Apr. 23, 2013, Mailed May 2, 2013, 3 pgs.

International Written Opinion for Application No. PCT/SG2013/000038, Search Completed Apr. 23, 2013, Mailed May 2, 2013, 5 pgs.

* cited by examiner

SEMI-SUBMERSIBLE PLATFORM WITH A MOVABLE SUBMERGIBLE PLATFORM FOR DRY DOCKING A VESSEL

FIELD OF THE INVENTION

This invention relates to a semi-submersible platform with a landing bay. More particularly, this invention relates to a semi-submersible platform having a landing bay with a movable platform sized to fit under a docked seaworthy vessel whereby the movable platform together with the docked vessel moves between a submerged position and an exposed position. Still more particularly, this invention relates to a semi-submersible platform with a landing bay whereby the landing bay has a stabilizing mechanism for holding a docked vessel steady when the platform and the vessel are moving between a submerged position and an exposed position using a lifting mechanism.

PRIOR ART

Offshore well drilling platforms have been widely used by oil-drilling companies over the past few decades. Of these, mobile semi-submersible drilling platforms are preferred over stationary platforms as mobile semi-submersibles are not dependent upon the surface of the ocean floor for a stable foundation. Another advantage of semi-submersibles is that these mobile platforms may be moved easily from one drilling site to another.

Through the years, as drilling sites move further away from landmasses, various logistical problems arise. In particular, oil-drilling companies face logistical issues in transporting personnel to and from the drilling sites. Typically, helicopters are used to transport personnel. Helicopters may be deployed when the drilling sites are located around 150 km offshore however, when the drilling sites are located around 300 km offshore, the use of helicopters as a regular means of large-scale transportation becomes inefficient. To address this logistical issue, it was proposed that accommodation platforms be built halfway between the coast and the drilling sites. In this manner, helicopters could be deployed to transport people from the coast to the accommodation platforms, and subsequently onwards to the drilling sites when necessary. However, such a solution is still costly and inefficient, as helicopters are still required to transfer personnel from the accommodation platforms to the drilling sites. Furthermore, the accommodation platforms would have to provide refuelling facilities for the helicopters and as the helicopters would still be travelling a substantial distance each day, fatigue may set in, resulting in an increase in accident rates.

The use of aircraft carriers as mobile accommodation hubs were proposed. By utilizing such large crafts, a large number of personnel could be transferred and normally, these crafts will be able to accommodate a large number of people. The downside to the use of aircraft carriers as a mobile accommodation hub is that aircraft carriers have thin hulls that are designed for speed and not for stability. Hence, when the aircraft carriers are immobile, they tend to sway with the motions of the waves making it almost impossible for helicopters to land on. Furthermore, due to the lack of stability of a stationary aircraft carrier, embarking/disembarking personnel from the craft to the drilling platform would be a risky and dangerous manoeuvre.

The use of high-speed vessels to transfer personnel to drilling sites has also been proposed. However, due to the rough sea conditions in which the drilling platforms operate in, embarking and disembarking passengers from a vessel becomes extremely difficult and dangerous. Under rough sea conditions, it is a challenge to ensure that the vessel remains stable long enough for the vessel to moor/dock for the embarkation/disembarkation of passengers or loading/unloading of material.

At the coast, or nearer to the coast, under normal weather conditions, the high speed vessels may either dock at ports or harbours to allow the vessel's passengers to embark/disembark easily. Most ports have an enclosure formed therein for receiving watercraft. This enclosure isolates the watercraft from the open ocean, mitigating wind, waves and current induced relative motion between the port and the watercraft. Additionally, to reduce the congestion at the port, watercraft lifting devices may be employed to lift vessels out of the water to free up space for incoming vessels. The watercraft lifting devices that may be utilized are dry dock lift apparatuses, partially submerged dry docks and/or floating dry docks.

A dry dock lift apparatus is described in US Patent Publication No. 2009/0067961 A1 as published on 12 Mar. 2009 in the name of Luis Perez-Rodenas Espada. This publication discloses a raised marina berth having a series of upper and lower movable platforms supported on parallel cross members. The platforms are for the berthing and launching of vessels. A docking vessel berthed at the lower platform will be raised vertically through the use of a system of cables or slings. For stability and even load distribution, these cables or slings are fixed to the lower movable platform and to the parallel cross members. In turn, the cross members are supported by four cradles which are planted firmly on solid ground. These four cradles are anchored to a marine bottom to provide a solid base for the dry dock lift apparatus. In a preferred embodiment, two cradles are deployed to support each cross member. The cradles are in turn securely anchored to the marine bottom to ensure even load distribution.

Another type of dry dock lift apparatus is described in U.S. Pat. No. 7,419,329 B1 as published on 2 Sep. 2008 in the name of Craig Allen Tafoya. This publication discloses a portable marine lift for the lifting and off loading of marine vessels. The disclosed design may be adapted with various vessel supporting apparatus such as rails and/or cradle systems. The design has at least one movable platform and a plurality of lift pods that are attached to the platform. The feet of the lift pod anchors firmly to the seabed providing a stable base for the movable platform. A vessel berthed at the platform may be raised/lowered vertically through the use of conventional jacking units located at each lift pod. In preferred embodiments, the lift pods of evenly distributed around the movable platform to ensure that the weight of the vessel may be even distributed to the seabed via the anchored feet of the lift pods.

A buoyant watercraft lift system with a convertible levelling system is disclosed in US Patent Publication No. 2008/0008528 A1 as published on 10 Jan. 2008 in the names of Kenneth E. Hey and Bryce M. Koister. This publication discloses a floating watercraft lift for raising and lowering a vessel in water. In the disclosed design, the watercraft lift has a plurality of air tanks, each configured with an internal chamber to receive and release pressurized air. Each air tank is connected to a swing arm. When the air tank receives sufficient pressurized air, the air tank has sufficient buoyancy to lift a docked watercraft out of the water. When the air tank releases the pressurized air, this causes the swing arms to release from a raised position thus submerging the hull of the docked watercraft into the water. This design may only be applied in situations whereby a watercraft is to be lifted in calm water conditions and in docking situations whereby the watercraft is located near to a landmass. Under rough sea conditions, this design would not result in a stable "dry docking" apparatus as the design disclosed in this publication would be unable to achieve the level of stability required to operate under rough sea conditions. Furthermore, this design does not provide a guiding or stabilizing mechanism for guiding a watercraft safely into the docking area under rough sea conditions and for holding the watercraft stable when the watercraft is being raised.

Therefore, for the purposes of a mobile accommodation platform for oil drilling operations, those skilled in the art are constantly looking for ways to provide a mobile accommodation platform with berthing means to allow a vessel to dock safely under unpredictable and/or rough sea conditions.

SUMMARY OF INVENTION

The above and other problems in the art are solved and an advance in the art is made in accordance with this invention. A first advantage of a semi-submersible platform with a landing bay in accordance with this invention is that this semi-submersible provides a landing bay for the berthing of vessels at offshore drilling sites. A second advantage of a wearable speaker system in accordance with this invention is that the landing bay has a movable submergible platform that is used to raise and lower a berthed vessel within the landing bay. A third advantage of a wearable speaker system in accordance with this invention is that the landing bay of the semi-submersible has a stabilization mechanism for holding the vessel steady when the vessel is approaching the landing bay and when the vessel is being raised or lowered.

In accordance with an embodiment of this invention, a wearable speaker system in accordance with this invention comprises a semi-submersible structure. The semi-submersible structure has a landing bay located within. The landing bay is accessible by an opening through which docking vessels may pass through. The landing bay further comprises a platform sized to fit under a docking vessel, a stabilizing mechanism for holding the docked vessel stable and a lifting mechanism for moving the platform between a submerged position and a raised position. In the submerged position, the platform is at a depth beneath the surface of the water and at a depth beneath the hull of the docking vessel. In the raised position, the platform together with the docked vessel is raised out of the water to a predetermined height. As the vessel is raised, the stabilizing mechanism holds the docked vessel level, preventing the vessel from tipping over and hitting the sides of the landing bay.

In accordance with an embodiment of this invention, the semi-submersible structure comprises a first and a second semi-submersible pontoon. The pontoons are positioned substantially parallel to one another and are spaced apart to define an open area between them.

In accordance with an embodiment of this invention, the semi-submersible structure further comprises a first plurality of support columns extending upwardly from the first semi-submersible pontoon whereby these support columns are substantially aligned in a parallel manner to one another. A second plurality of support column also extends upwardly from the second semi-submersible pontoon and these support columns are also substantially aligned in a parallel manner to one another, In accordance with an embodiment of this invention, the lifting mechanism are affixed to a portion of the first and second semi-submersible pontoons.

In accordance with an embodiment of this invention, the landing bay is located between a first end of the first and second semi-submersible pontoons.

In accordance with an embodiment of this invention, a platform spans a portion of the first and second plurality of support columns at the second end of the first and second semi-submersible pontoons.

In accordance with another embodiment of this invention, the stabilizing mechanism comprises a plurality of suction moorings having a first ends affixed to the semi-submersible structure and a second end for attaching to the sides of docking vessels.

In accordance with another embodiment of this invention, the lifting mechanism comprises a plurality of hydraulic lifts.

In accordance with yet another embodiment of this invention, the semi-submersible structure comprises a guiding mechanism for guiding the docking vessel through the opening in the landing bay.

In accordance with an embodiment of this invention, the guiding mechanism comprises a docking car setup.

In accordance with an embodiment of this invention, the semi-submersible structure further comprises embarkation and disembarkation mechanisms. The first ends of these devices are positioned adjacent to the semi-submersible structure and the second ends are positioned adjacent to the docked vessel. In accordance with some embodiments of this invention, the embarkation and disembarkation mechanisms comprises telescopic personnel access systems.

In accordance with an embodiment of this invention, the securing mechanism further comprises a plurality of air bags affixed on a side of the platform. These air bags are for receiving the hull of the docking vessel.

In accordance with an embodiment of this invention, the semi-submersible platform comprises crew quarters, helicopter pads and lifeboats.

BRIEF DESCRIPTION OF THE DRAWINGS

The above advantages and features of a method and apparatus in accordance with this invention are described in the following detailed description and are shown in the drawings.

DETAILED DESCRIPTION

This invention relates to a semi-submersible platform with a landing bay. More particularly, this invention relates to a semi-submersible platform having a landing bay with a movable platform sized to fit under a docked seaworthy vessel whereby the movable platform together with the docked vessel moves between a submerged position and an exposed position. Still more particularly, this invention relates to a semi-submersible platform with a landing bay whereby the landing bay has a stabilizing mechanism for holding a docked vessel steady when the platform and the vessel are moving between a submerged position and an exposed position using a lifting mechanism.

Figure 1:
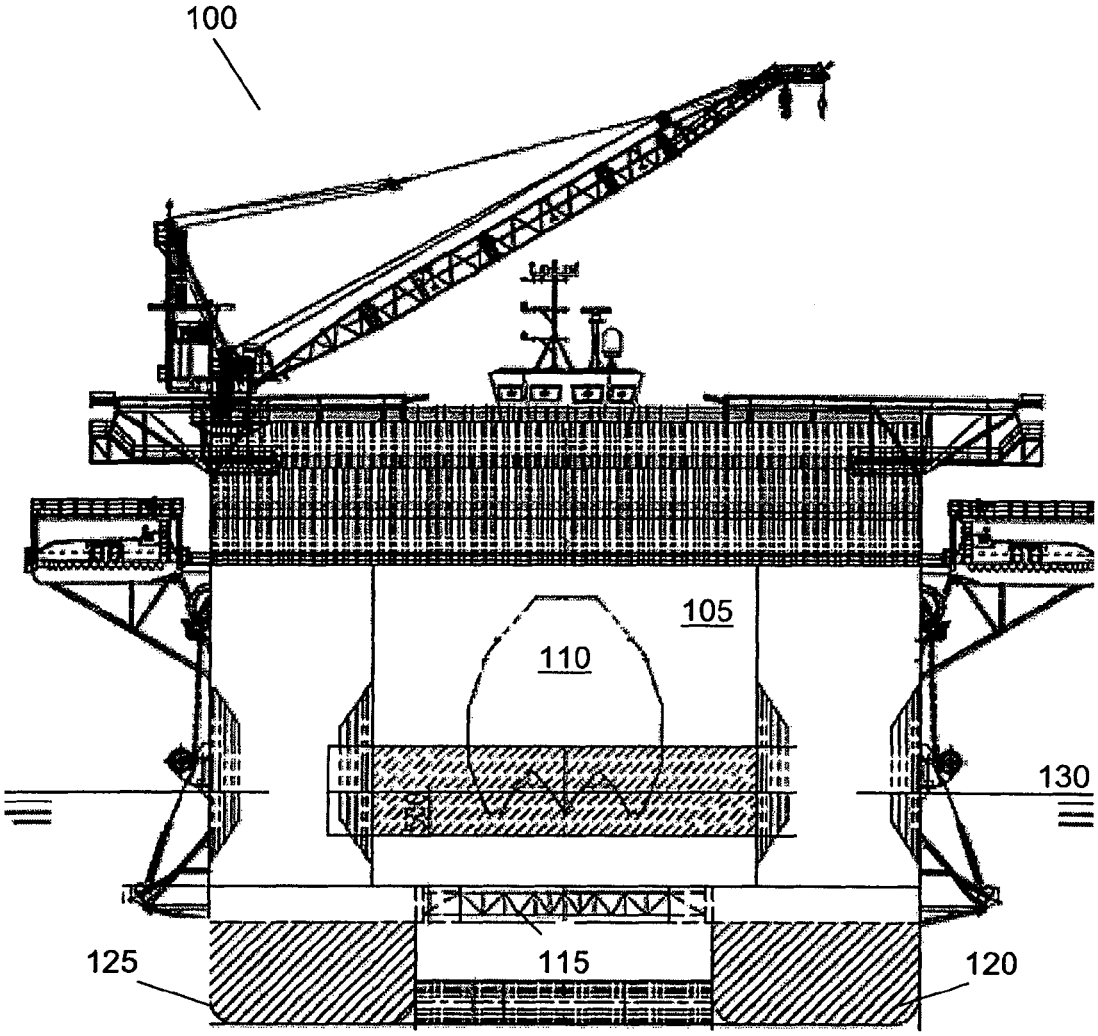
FIG. 1 illustrating a frontal view of a semi-submersible accommodation hub with a movable submergible platform in accordance with an embodiment of this invention.

Semi-submersible platform 100, shown in FIG. 1, is a semi-submersible platform with a landing bay in accordance with an embodiment of this invention. Semi-submersible platform 100 comprises pontoons 120 and 125. Between the first ends of pontoons 120 and 125, there is an opening. This opening allows vessels to access landing bay 105 located within semi-submersible platform 100. FIG. 1 illustrates landing bay 105 located within semi-submersible platform 100. In this drawing, vessel 110 is shown to be berthed within landing bay 105. Platform 115 is a movable platform located within landing bay and platform 115 is positioned between pontoons 120 and 125. Platform 115 is arranged such that platform 115 fits under vessel 110 when vessel 110 is berthed within landing bay 105. In an embodiment, platform 115 may comprise a planar truss structure. One skilled in the art will recognize that platform 115 may comprise of other types of planar structures without departing from this invention.

In operation, part of semi-submersible 100 will be submerged beneath water level 130. Vessel 110 enters landing bay 105 through the opening located between pontoons 120 and 125. As shown in FIG. 1, when vessel 110 is berthed within landing bay 105, vessel 110 will be located above submerged platform 115. When vessel 110 is located within landing bay 105, the structure of landing bay 105 will shield vessel 110 from external elements thus allowing vessel 110 to dock safely. Once vessel 110 is safely berthed within landing bay 105, platform 115 will move from a submerged state to an exposed state. This causes platform 115 to come into contact with the hull of vessel 110. As platform 115 rises out of the water, platform 115 raises vessel 110 out of the water as well. Once berthed vessel 110 has been raised out of the water, the embarkation/disembarkation and/or loading/unloading procedures may then safely take place as vessel 110 is now in an extremely stable position. When vessel 110 is in such a position, vessel 110 will be immune to external elements such as strong winds and any other external factors that are typically associated with rough offshore conditions as the structure of semi-submersible 100 will effectively act as a barrier for vessel 110. Furthermore, once vessel 110 has been raised out of the water, vessel 110 becomes immune to rough sea conditions as vessel 110 is no longer in contact with the sea. Unlike the prior art, whereby a watercraft is raised out of the water only under calm sea conditions, semi-submersible 100 is able to raise vessel 110 out of the water under rough sea conditions.

Parameters that affect the motion of semi-submersible platform 100 are taken into consideration when semi-submersible platform 100 is designed. The design features that affect the motion of semi-submersible platform 100 are the shape and the size of pontoons 120,125. Specifically, pontoons 120 and 125 have been designed to minimize the motions of semi-submersible platform 100. Additionally, the shape and the size of structural columns (see FIG. 4) that extend upwardly from pontoons 120 and 125 were also designed to minimize the motions of semi-submersible platform 100. The metacentric height of semi-submersible platform 100 is designed to be as large as possible resulting in a reduction of motion of semi-submersible platform 100. Furthermore, the waterplane area of semi-submersible platform 100 is minimized thus reducing the resonance between the motions of the waves and the natural frequency of semi-submersible platform 100.

Additionally, to reduce the heave motion of semi-submersible platform 100, pontoons 120 and 125 are submerged below water level 130. These features provide semi-submersible platform 100 with the required strength and air gap to withstand the environmental loads induced by wave actions when semi-submersible platform 100 is operating under offshore drilling conditions. As such, semi-submersible platform 100 has a natural heave period in the range between 18 seconds (0.35 rad/sec) and 22 seconds (0.28 rad/sec). At offshore drilling sites, the wave excitation periods are typically between 8 seconds (0.79 rad/sec) and 15 seconds (0.42 rad/sec). The heave motion of semi-submersible platform 100 is reduced because the natural frequency of platform 100 does not resonate with the excitation frequency of the waves. The mismatch between the natural frequency of semi-submersible platform 100 and the excitation of the waves results in a semi-submersible platform that has very low heave motions and remains stable throughout.

In an embodiment, semi-submersible platform 100 is used as an offshore accommodation hub. Semi-submersible platform 100 is suitable to be used as a mobile accommodation hub as the transfer of personnel back and forth from the accommodation hub is facilitated by the use of landing bay 105. Landing bay 105 allows vessels transporting personnel to safely dock within semi-submersible platform 100. Approaching vessels will enter landing bay 105 through the opening located between pontoons 120 and 125. Once safely berthed within landing bay 105, platform 115, which is submerged at the bottom of landing bay 105, is then raised out of the water. This action in turn raises the berthed vessel out of the water to a predetermined height. In this embodiment, the vessel is raised to a predetermined disembarking/embarking height. A telescopic personnel access system (not shown) located on either side of the accommodation hub may then be extended towards the docked vessel. Personnel may then board or disembark from the docked vessel easily. The telescopic personnel access system may comprise of self stabilizing retractable gangways that may actively compensate all vessel motions to ensure that the transfer of personnel back and forth from the docked vessel is done in a safe and efficient manner. The exact details of a telescope personnel access system is well known in the art and has been omitted for brevity. When semi-submersible platform 100 is used as an offshore accommodation hub, semi-submersible platform 100 may also be provided with crew quarters and crew facilities. This allows a large number of personnel to remain on semi-submersible 100 for extended periods.

Figure 2:
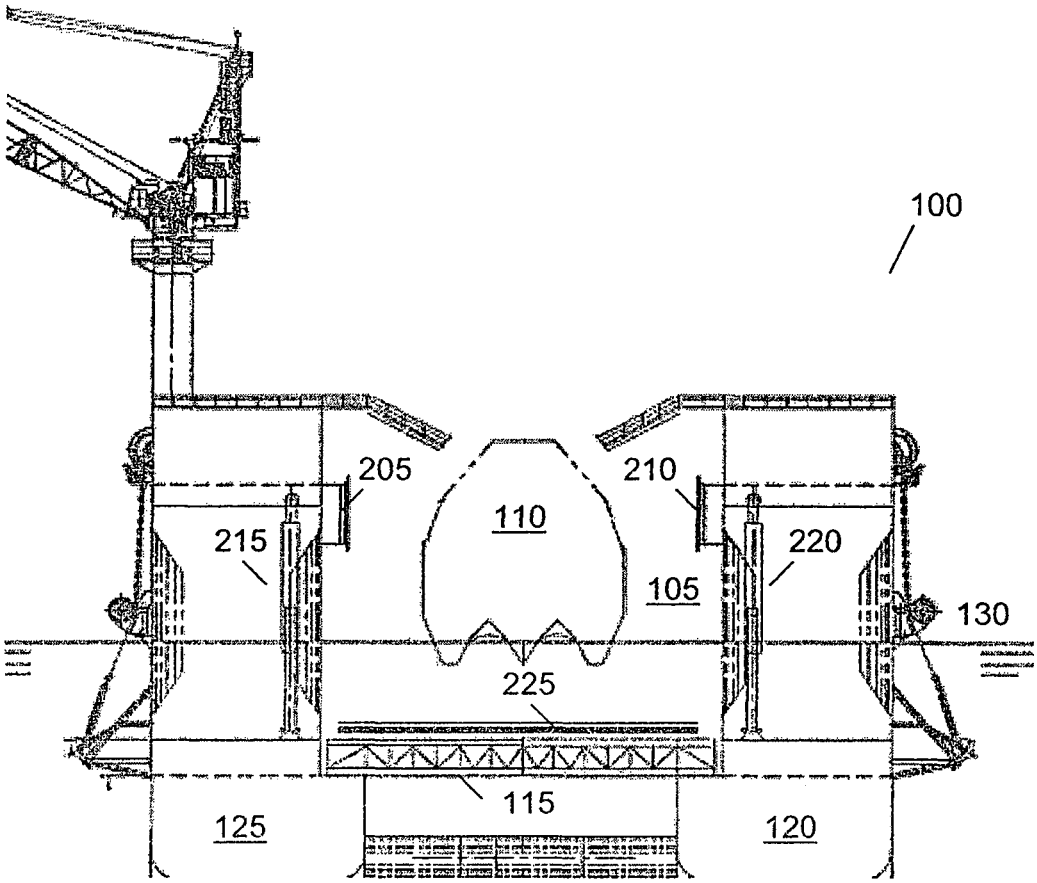
FIG. 2 illustrating a mid-ship view of a semi-submersible accommodation hub with a movable submergible platform in accordance with an embodiment of this invention.

As can be seen from FIG. 1, the width of the opening to landing bay 105 is slightly wider than the width of vessel 110. Hence, in order to avoid vessel 110 from bumping into semi-submersible 110 when vessel 110 is approaching landing bay 105, a securing mechanism is employed to hold vessel 110 steady as vessel 110 approaches landing bay 105. Such a securing mechanism is illustrated in FIG. 2. In an embodiment, mooring systems 205 and 210, which are positioned within landing bay 105, are used as a securing mechanism. Mooring systems 205 and 210 may comprise a suction cup, and associated suction control means operable to secure the suction cups against a vessel. For brevity, only the operation of mooring system 205 is disclosed. One skilled in the art will recognize that the operation of mooring system 210 may be similar to that of mooring system 210. In operation, as vessel 110 approaches landing bay 105, a suction pad (not shown) from mooring system 205 will detach from landing bay 105. The suction pad will be connected to mooring system 205 via a cable or a chain (not shown). This suction pad will be secured onto a side of approaching vessel 110. Similarly, a suction pad from mooring system 210 will be secured onto the opposing side of approaching vessel 110. As vessel 110 approaches landing bay 105, mooring systems 205 and 210 will automatically adjust the tension and/or length of the cables attached to the suction pads. By doing so, with the assistance of mooring systems 205 and 210, vessel 110 will be able to pass through the opening safely into landing bay 105.

Under rough sea conditions, when vessel 110 approaches landing bay 105 to dock, it will be difficult for vessel 110 to safely manoeuvre itself into landing bay 105. To overcome this obstacle, a docking mechanism (not shown) may be deployed to pull vessel 110 safely through the opening into landing bay 105. In an embodiment of this invention, the docking mechanism may comprise a docking car setup. The docking car setup consists of two rails located on each side of the semi-submersible structure. Affixed onto each of these rails are winches with cables or chains. In operation, these cables or chains are securely fastened onto vessel 110. The cables or chains are then winched, pulling vessel 110 towards landing bay 105. Mooring systems 205 and 210 may also be used to assist in holding vessel 110 stable as vessel 110 passes through the opening into landing bay 105.

Figure 3:
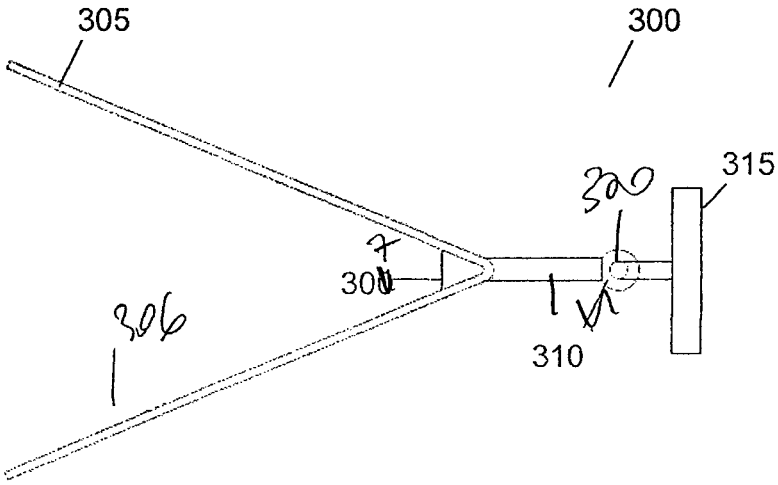
FIG. 3 illustrating a plan view of an embodiment of a docking mechanism.

In another embodiment, the docking mechanism may comprise a rigid yoke structure with an arm extending outwardly towards a vessel as shown in FIG. 3. Rigid yoke structure 300 has a general V-shape or U-shape with curved arms 305 and 306. Rotate-able member 307 is fastened at the meeting point of curved arms 305 and 306. Outwardly extending arm 310 is connected at one end to rotate-able member 307 and at the other end to rotate-able member 320. Rotate-able members 307 and 320 may rotate about a 360 degree axis thus allowing rigid yoke structure to assist in the stabilizing of a docking vessel. Rotate-able member 320 is connected on the other end to clasping member 315. Clasping member 315 is used to lock or fasten onto vessel 110 as vessel 110 approaches landing bay 105.

Figure 4:
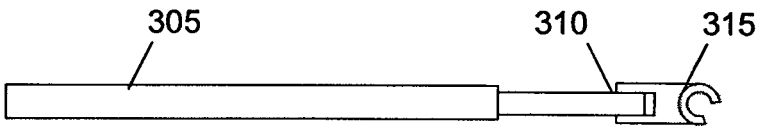
FIG. 4 illustrating a side view of an embodiment of a docking mechanism.

In operation, curved arms 305 and 306 are fastened onto rails located on either side of landing bay 105. When vessel 110 is approaching landing bay 105, rigid yoke structure 300 moves outwardly from landing bay 105 along the rails. Clasping member 315 of outwardly extending rigid yoke structure 300 then upon impact with docking vessel 110 fastens onto vessel 110. Vessel 110 automatically aligns with landing bay 105 due to the position of arm 310 on rigid yoke structure 300. Rigid yoke structure 300 then pulls vessel 110 into landing bay 105. It should be noted that the two opposing ends of the rigid yoke structure are affixed with bearings (not shown) that allow the rigid yoke structure to compensate for the yaw and roll of vessel 110. Rotate-able members 307 and 320 also assist in the compensation of the yaw and roll of vessel 110 as vessel 110 is docking. FIG. 4 shows the side view of rigid yoke structure 300. One skilled in the art will recognize that clasping member 315 may comprise other clasping or fastening means without departing from this invention.

Figure 5:
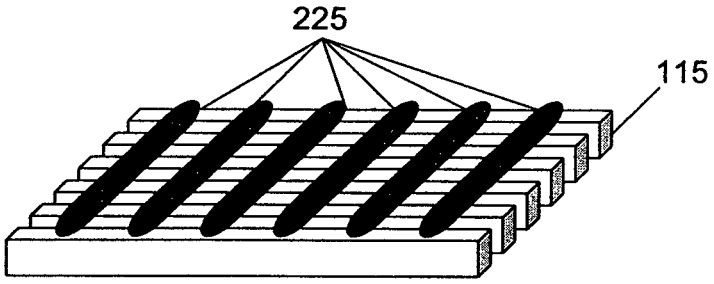
FIG. 5 illustrating an enlarged view of a movable submergible platform with a plurality of air bags.

Within landing bay 105, mooring systems 205 and 210 assists in the stabilization of vessel 110, preventing vessel 110 from bumping into the sides of landing bay 105. Additionally, mooring systems 205 and 210 assist in holding vessel 110 steady when vessel 110 is raised by platform 115. However, mooring systems 205 and 210 alone may not be sufficient to hold vessel 110 stable when platform 115 is moved from a submerged position to a raised position. When this happens, the upper surface of platform 115 will come into contact with the hull of vessel 110. As the hulls of most watercraft do not provide a flat stable surface, securing means has to be provided to ensure that vessel 110 does not tip when vessel 110 is being raised out of the water or lowered into the water. This can be achieved by introducing air bags 225 between the hull of vessel 110 and the upper surface of platform 115. Air bags 225 acts as a cushion for the hull of vessel 110, enveloping the hull of vessel 110 when platform 115 is raised thus holding vessel 110 steady. A sample arrangement of air bag 225 is disclosed in FIG. 5. One skilled in the art will recognize that air bags 225 may be arranged in various configurations and are not limited to the arrangement shown in FIG. 5. In FIG. 5, air bags 225 were arranged in a row to allow the weight of docked vessel 110 to be evenly distributed across the entirety of platform 115.

Referring back to FIG. 2, lifting mechanisms 215 and 220 that are located within landing bay 105 are used to raise or lower platform 115. In an embodiment, lifting mechanisms 215 and 220 may consist of hydraulic lifts. These hydraulic lifts are connected to hydraulic cylinders that are fixed to the sides of the semi-submersible structure. The hydraulic cylinders are designed in such a way that they are capable of taking the total weight of platform 115, and vessel 110 along with the personnel in the vessel.

The total load of vessel 110, platform 115 and the personnel will be distributed evenly amongst the four cylinders. One skilled in the art will recognize that other devices or apparatuses may be used as lifting mechanisms without departing from this invention. In operation, semi-submersible platform 100 will be moored at an offshore location at its operating draft. The operating draft of semi-submersible platform 100 is the vertical distance between the bottom of semi-submersible platform 100 floating in water and water level 130. The additional weight of vessel 110 on platform 115 would result in an increase in the operating draft. Thus the additional weight of vessel 110 on platform 115 is included in the design of semi-submersible platform 100.

In another embodiment, platform 115 may be provided with a heave compensator mechanism to dampen the movement of semi-submersible platform 100 due to the undulating motions of the waves. The heave compensation mechanism incorporated into platform 115 may comprise a drilling string compensator setup. One end of the drilling string compensator setup may be connected to the bottom of platform 115 while the other end of the drilling string compensator setup may be anchored to the sea bed. The heave compensator mechanism connected to platform 115 ensures smooth operation of platform 115 by minimizing downtime incidents in rough weather conditions. The heave compensator mechanism will also enhance the level of accuracy of platform 115 when platform 115 is raised from a submerged position to a raised position.

Figure 6:
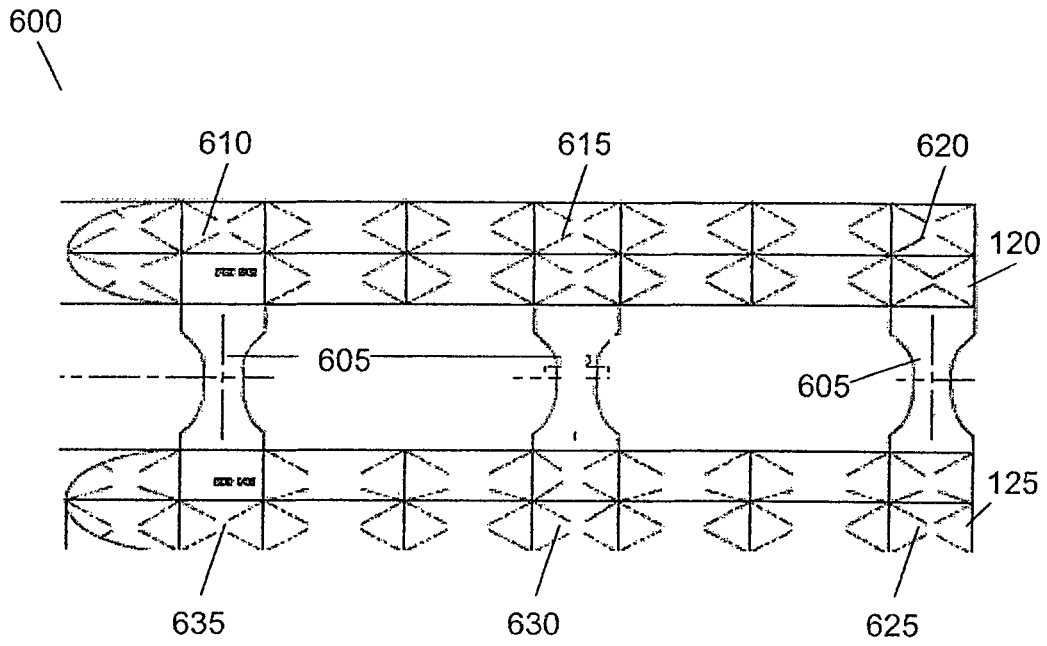
FIG. 6 illustrating a pontoon bottom of a semi-submersible accommodation hub in accordance with an embodiment of this invention.

As mentioned earlier, in existing prior art designs, the disclosed dry docks or the disclosed watercraft lifting apparatus are either applicable for applications in calm water, shallow waters or on dry land. These limitations are inherent of previously disclosed designs as these designs do not have a heave compensation system that allows a watercraft to incorporate a lift apparatus to lift another watercraft in deep water or under rough offshore conditions that are typically associated with oil drilling sites. This invention addresses these issues by utilizing the heave compensation system of semi-submersible platform 100. The various levels of a semi-submersible are set out below. FIG. 6 illustrates the bottom level of the semi-submersible, which is that of pontoon level 600. Pontoons 125 and 120 together form the water plane area for pontoon level 600. Pontoons 120 and 125 are substantially parallel to each other and are connected by connecting girders 605. Pontoons 120 and 125 comprise watertight ballasts that contribute to the buoyancy of semi-submersible platform 100. Semi-submersible platform 100 may be raised or lowered by adjusting the ballasting of pontoons 120 and 125. In operation, pontoons 120 and 125 are submerged beneath water level 130, increasing the draft of semi-submersible platform 100. This facilitates the stability of platform 115 and docked vessel 110 when platform 115 is raised from a submerged position to a raised position.

Structural columns 610, 615, 620, 625, 630 and 635 extend upwardly from pontoons 120 and 125. Structural columns 610, 615, 620, 625, 630 and 635 are spaced apart from one another to ensure that pontoons 120 and 125 may support a load. Structural columns 610, 615, 620, 625, 630 and 635 which have relatively large diameters rise upwards from pontoon level 400 to above the surface of the ocean's waves. Structural columns 610, 615, 620, 625, 630 and 635 are used to support the load of semi-submersible 100. When semi-submersible 100 is deployed for offshore operations, pontoons level 600 will be submerged below the water surface. Pontoon level 600 is located below the level of the ocean's waves to reduce the wave-induced response of the platform.

Figure 7:
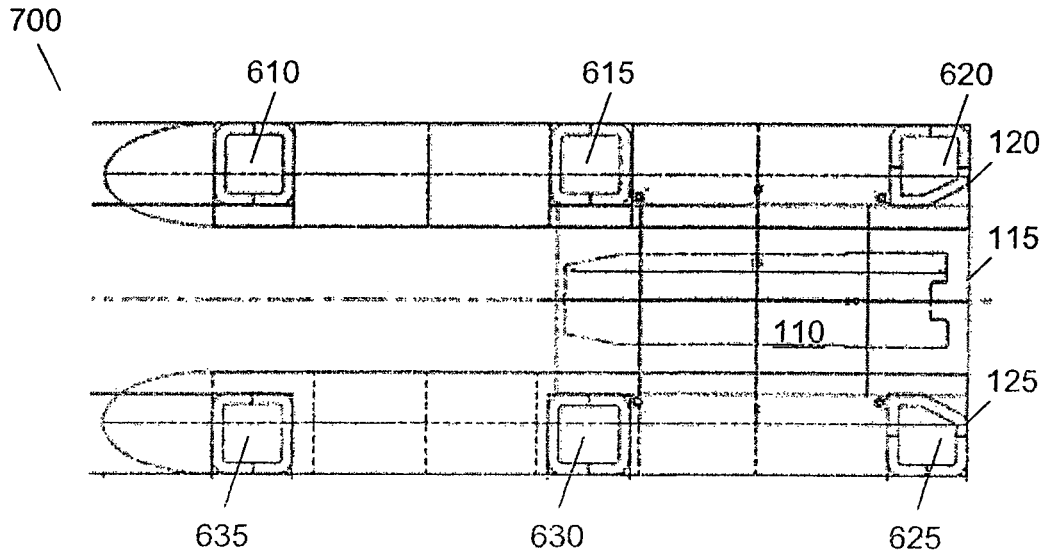
FIG. 7 illustrating a pontoon deck of a semi-submersible accommodation hub in accordance with an embodiment of this invention.

The level above pontoon level 600 is cargo level 700. FIG. 7 illustrates pontoon deck 700. Pontoon deck 700 which comprises of platform 115 is also submerged under the ocean's waves. For illustration purposes, vessel 110 is illustrated in this drawing to show the positioning of vessel 110 in relation to platform 115 at pontoon deck 700. FIG. 7 also illustrates structural columns 610, 615, 620, 625, 630 and 635 that are evenly spaced across pontoons 120 and 125 to achieve a stable and even load distribution across the pontoons.

Figure 8:
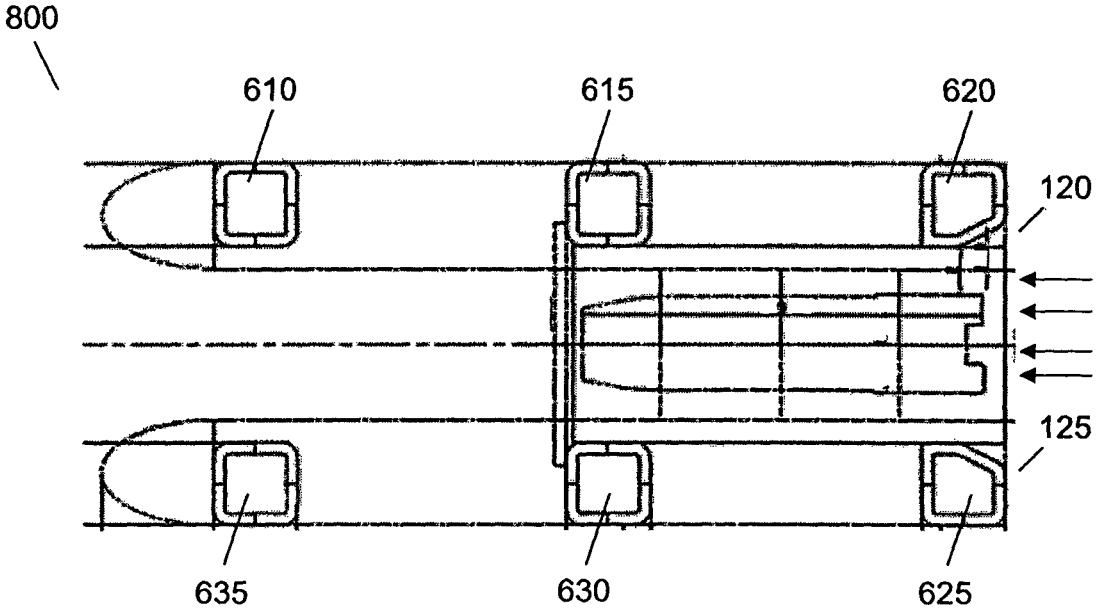
FIG. 8 illustrating a cargo deck of a semi-submersible accommodation hub in accordance with an embodiment of this invention.

FIG. 8 illustrates cargo deck level 800 of semi-submersible 100. This drawing illustrates the opening (indicated by arrows) into landing bay 105. Vessels that are approaching landing bay 105 will enter through the opening located between structural columns 620 and 625 located on pontoons 120 and 125 respectively. One skilled in the art will recognize that the distance between pontoons 120 and 125 may be altered in accordance with the width of the vessel that is to be docked within landing bay 105 without departing from this invention.

Figure 9:
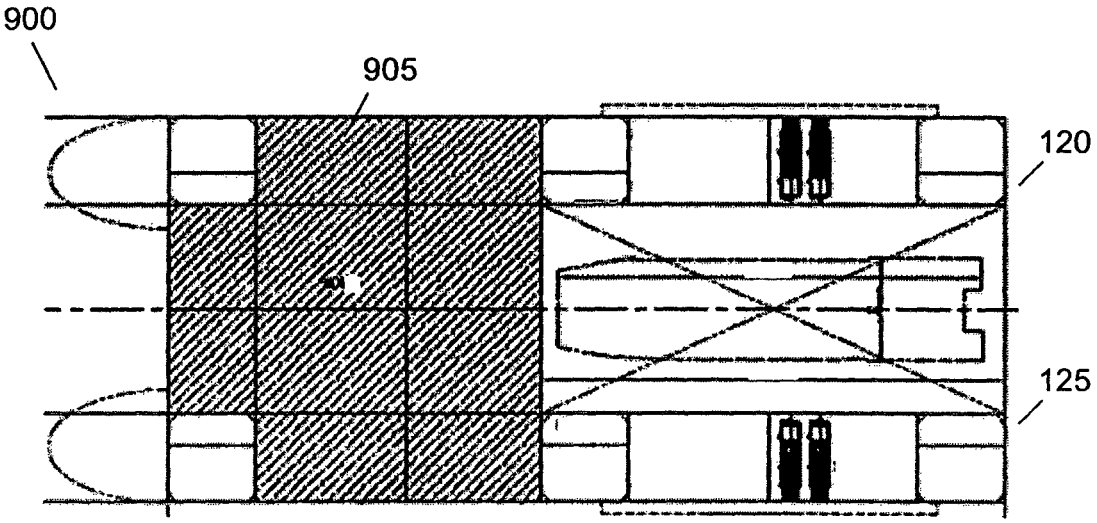
FIG. 9 illustrating a main deck of a semi-submersible accommodation hub in accordance with an embodiment of this invention.

FIG. 9 illustrates main deck 900 of semi-submersible 100. Structural columns 610, 615, 630 and 635, support the load of deck 905. Deck 905 may be used to support production facilities, electrical generators and accommodation quarters for the crew. One skilled in the art will recognize that different modules of equipment and facilities may be interchanged to accommodate the specific requirements of semi-submersible 100 without departing from this invention.

Figure 10:
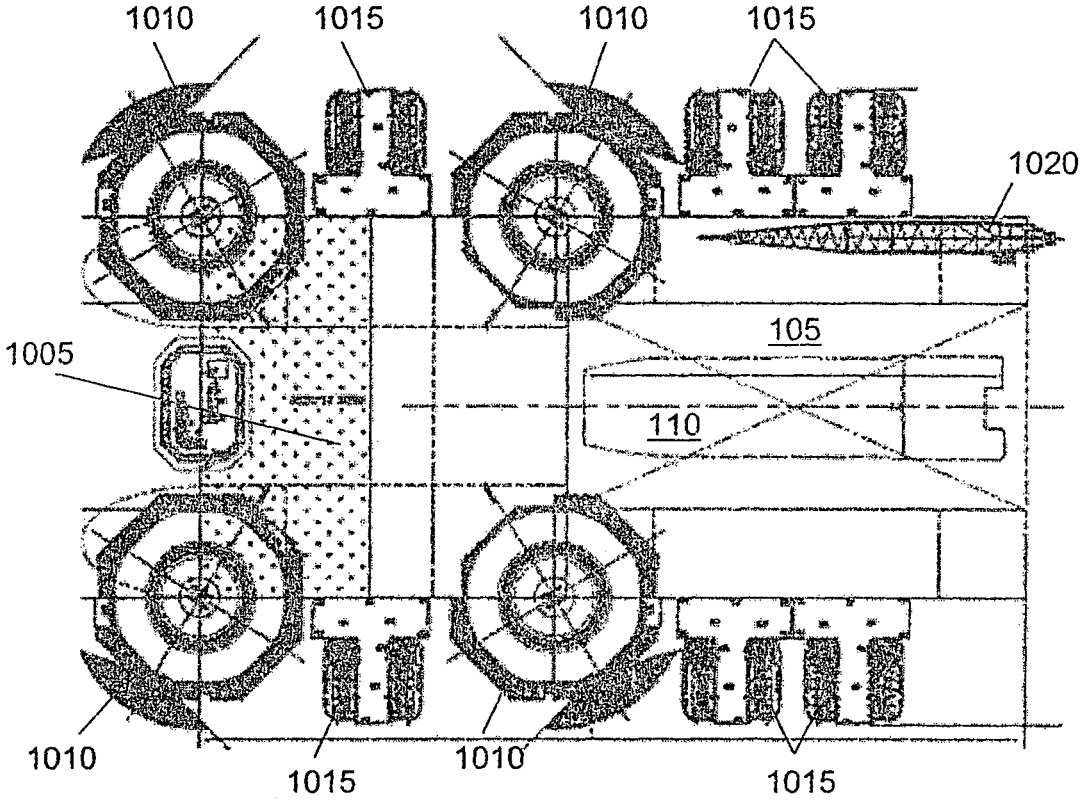
FIG. 10 illustrating a top view of a semi-submersible accommodation hub in accordance with an embodiment of this invention.
Figure 11:
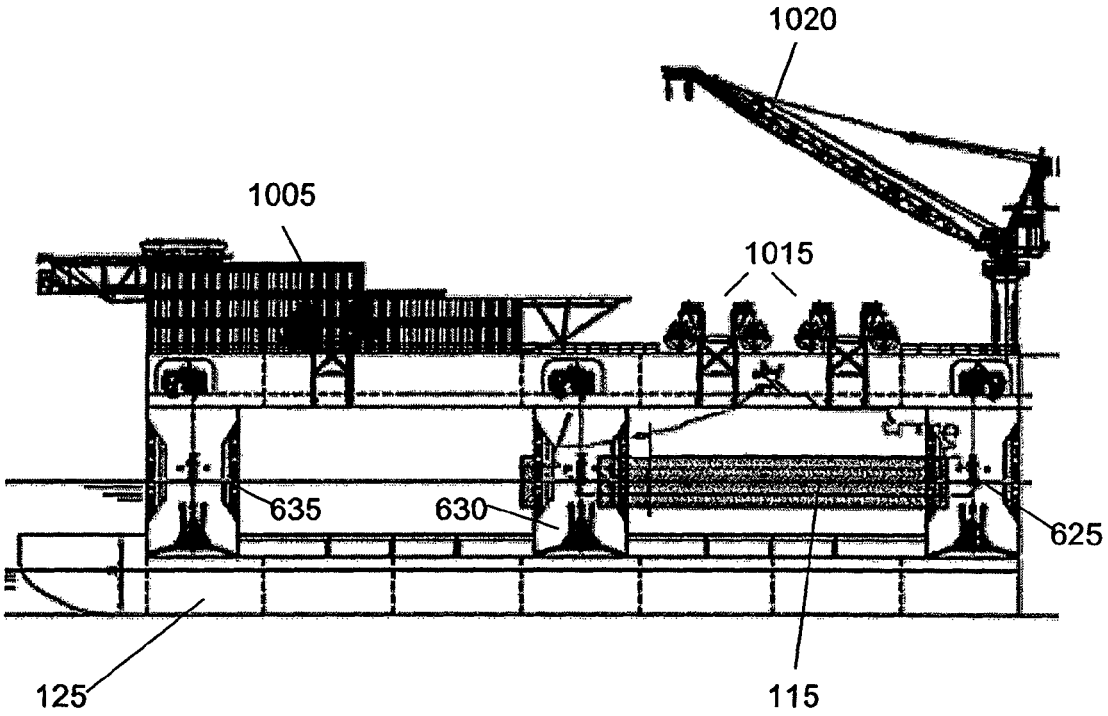
FIG. 11 illustrating an outboard of a semi-submersible accommodation hub in accordance with an embodiment of this invention.

FIG. 10 illustrates the top view and FIG. 11 illustrates the outboard view of an embodiment of this invention. In these drawings, crew quarters 1005 may be positioned between helicopter landing pads 1010. Lifeboats 1015 are strategically positioned around semi-submersible 100 for the crewmembers of semi-submersible 100 in the case of emergencies. Crane 1020 is located above structural column 620 and may be used in the loading/unloading of cargo from deck 905. Deck 905 is designed in an open frame manner allowing modules 1005, 1010 and 1015 to be easily removed and replaced by other modules to change the function of semi-submersible 100 from an accommodation hub to a gas production unit depending on the required field of the operation.

Semi-submersible 100 is advantageous over prior art dry docking apparatuses as semi-submersible 100 is provided with landing bay 105 with movable submergible platform 115 that is able to raise and lower other watercraft under various sea conditions. As mentioned previously, vessel 110, that is docked above platform 115 may be raised or lowered by lifting mechanisms 215 and 220. Furthermore, the raising and lowering of vessel 110 is done in a stable and steady manner as the additional weight of raised vessel 110 is absorbed by the design of semi-submersible 100.

The above is a description of a semi-submersible platform with a movable submergible platform that is able to lift watercraft under various ocean conditions. It is foreseen that those skilled in the art can and will design alternative embodiments of this invention as set forth in the following claims.

The invention claimed is:

1. A semi-submersible platform comprising:

a semi-submersible structure; and a landing bay inside said semi-submersible structure accessible by vessels through an opening through said semi-submersible structure; wherein said landing bay comprises:

a platform sized to fit under a docking vessel and movable between a submerged position in which said platform is beneath the surface of water in said landing bay to a depth that allows said vessel to float over said platform, and an exposed position in which said platform holds said docking vessel out of the water;

a lifting mechanism for moving said platform between said submerged position and said exposed position; and a stabilizing mechanism comprising a plurality of suction moorings having a first end affixed to said semi-submersible structure and a second end for attaching to the sides of said docking vessel for holding said docking vessel in a level position responsive to said platform moving from said submerged position to said exposed position.

2. The semi-submersible platform of claim 1 wherein said semi-submersible structure comprises:

a first semi-submersible pontoon on a first side of said structure; and a second semi-submersible pontoon on a second side of said structure wherein said first and second semi-submersible pontoons are substantially parallel and spaced apart to define an open area between said first and second semi-submersible pontoons.

3. The semi-submersible structure of claim 2 further comprising:

a first plurality of support columns extending out of a top side of said first semi-submersible pontoon wherein said first plurality of support columns are substantially aligned parallel to one another; and a second plurality of support columns extending out of a top side of said second semi-submersible pontoon wherein said second plurality of support columns are substantially aligned parallel to one another.

4. The semi-submersible structure of claim 2 wherein said lifting mechanism is affixed a portion of said first semi-submersible pontoon and a portion of said second semi-submersible pontoon.

5. The semi-submersible structure of claim 3 wherein said landing bay is between a first end of said first and second semi-submersible pontoons.

6. The semi-submersible structure of claim 5 further comprising:

a platform spanning a portion of said first and second plurality of support columns at a second end of said first and second semi-submersible pontoons wherein said platform spans said open area between said pontoons.

7. The semi-submersible platform of claim 1 wherein said lifting mechanism comprises:

a plurality of hydraulic lifts.

8. The semi-submersible platform of claim 1 wherein said semi-submersible structure further comprises:

a guiding mechanism for guiding said docking vessel through said opening through said semi-submersible structure.

9. The guiding mechanism of claim 8 wherein said guiding mechanism comprises a docking car setup.

10. The guiding mechanism of claim 8 wherein said guiding mechanism comprises a rigid yoke structure.

11. The semi-submersible platform of claim 1 wherein said semi-submersible structure further comprises:

a disembarking mechanism having a first end adjacent said semi-submersible structure and a second end positioned adjacent said docking vessel.

12. The semi-submersible structure of claim 11 wherein said disembarking mechanism comprises a telescopic personnel access system.

13. The semi-submersible platform of claim 1 wherein said semi-submersible structure further comprises:

an embarking mechanism having a first end adjacent said semi-submersible structure and a second end positioned adjacent said docking vessel.

14. The semi-submersible structure of claim 13 wherein said embarking mechanism comprises a telescopic personnel access system.

15. The semi-submersible platform of claim 1 wherein said stabilizing mechanism further comprises:

a plurality of air bags affixed on a first side of said platform for receiving said docking vessel.

16. The semi-submersible platform of claim 1 further comprising:

crew quarters.

17. The semi-submersible platform of claim 1 further comprising:

helicopter pads.

18. The semi-submersible platform of claim 1 further comprising:

lifeboats.

* * * * *